United States Patent [19]

Krynski

[11] 4,353,553

[45] Oct. 12, 1982

[54] DROP TARGET ASSEMBLY FOR PINBALL GAME

[75] Inventor: Edward P. Krynski, Downers Grove, Ill.

[73] Assignee: D. Gottlieb & Co., Northlake, Ill.

[21] Appl. No.: 234,731

[22] Filed: Feb. 17, 1981

[51] Int. Cl.[3] ..... A63D 3/02

[52] U.S. Cl. ..... 273/121 R; 273/127 R

[58] Field of Search ..... 273/127 R, 127 D, 129 V, 273/121 A, 118 A, 119 A, 120 A

[56] References Cited

U.S. PATENT DOCUMENTS

| | | | |
|---|---|---|---|
| 4,212,466 | 7/1980 | Wildman et al. | 273/129 V X |
| 4,221,384 | 9/1980 | Krynski | 273/121 A X |
| 4,257,604 | 3/1981 | Grabel et al. | 273/127 R |
| 4,260,156 | 4/1981 | Momura | 273/127 R |

*Primary Examiner*—George J. Marlo

*Attorney, Agent, or Firm*—Arnold, White & Durkee

[57] ABSTRACT

An improved drop target assembly provides first and second target surfaces for ball engagement at a given drop target location. Only one of the target surfaces is engageable at any given time. Preferably, both target surfaces are on a single, vertically movable support member such that dropping of the member to lower the first target surface to a below-playfield position drops the second target surface into a ball engageable position. One or more switch contacts are provided for indicating ball engagement with the target surfaces and the dropping of the first target surface to the below-playfield position. A housing is provided to shield the second target surface from view when the first target surface is in the above-playfield position.

5 Claims, 9 Drawing Figures

DROP TARGET ASSEMBLY FOR PINBALL GAME

BACKGROUND OF THE INVENTION

The present invention relates generally to pinball games and more specifically relates to drop target assemblies for flipper type pinball games.

The popularity of pinball games is due to a large extent to the thought and ingenuity of the designers in incorporating new and different features to make the games more interesting and more exciting during play. One pinball game feature commonly employed by the pinball game designer is the so-called drop target. A drop target normally projects above the upper surface of the playfield and, when hit by a rolling ball projected by flippers or other devices, responds by dropping into a recessed position below the surface of the playfield.

An improved drop target assembly is described in U.S. Pat. No. 4,221,384, issued Sept. 9, 1980 in the name of Edward P. Krynski (hereafter the Krynski patent). In this improved drop target assembly, ball engagement of one drop target drops not only that target but another target. While the improved drop target assembly in the Krynski patent is believed to have added to the pinball game designers repertoire of available features, additional novel improvements are continually sought.

SUMMARY OF THE INVENTION

The present invention provides yet another improvement in drop target assemblies for flipper type pinball games which presents a second target surface for ball engagement after the first target surface has been engaged by the ball and dropped below the playfield surface. The second target surface provides a visual appearance distinctive from that of the first target surface such that the appearing of the new surface, coupled with the playfield activity of dropping the first target surface, promotes player interest and appeal.

According to one aspect of the invention, an improved drop target assembly for a flipper type pinball game comprises a mechanism, including at least one slidable target member, which defines at least first and second ball engageable target areas above the playfield surface. The slidable member defines the first target area and is movable to advance the first target area from a position above the surface of the playfield to a position below the surface of the playfield without advancing the second target below the playfield surface. The target areas are configured so that only one of them is exposed for ball engagement at any given time. A moving mechanism is provided for moving the one slidable member upon ball engagement of the first target area, thereby dropping the first target area to the below-surface position and exposing the second target area for ball engagement.

In the preferred and illustrated embodiment, the slidable member defines both target areas. The second target area is defined at a location substantially at the end of the elongated member, and the first target area is defined at a location spaced from the end of the member and adjacent the end location.

In yet another preferred embodiment, the drop target assembly includes a housing disposed on a playfield surface for shielding the second target area when the first target is in the above-surface position. The housing defines an opening of a size to allow ball entry for engaging the target via the opening. The second target area is disposed at an elevation above the opening when the first target area is behind the opening. Upon dropping of the first target area, the second target area drops behind the opening to allow viewing and ball engagement thereof.

In yet a more specific embodiment, first and second sets of switch contacts are provided. The first set of switch contacts is disposed behind the target areas to be actuable upon ball engagement thereof. The second set of switch contacts is disposed to be actuated by the dropping mechanism for indicating when the first target has been advanced to the below-surface position.

Accordingly, it is a general object of the present invention to provide a new and improved drop target assembly which features multiple target surfaces for a given drop target location.

BRIEF DESCRIPTION OF THE DRAWINGS

The above noted and other objects and advantages of the present invention will become apparent upon reading a detailed description of a preferred embodiment in conjunction with the appended drawings.

DESCRIPTION OF A PREFERRED EMBODIMENT

Figure 6:
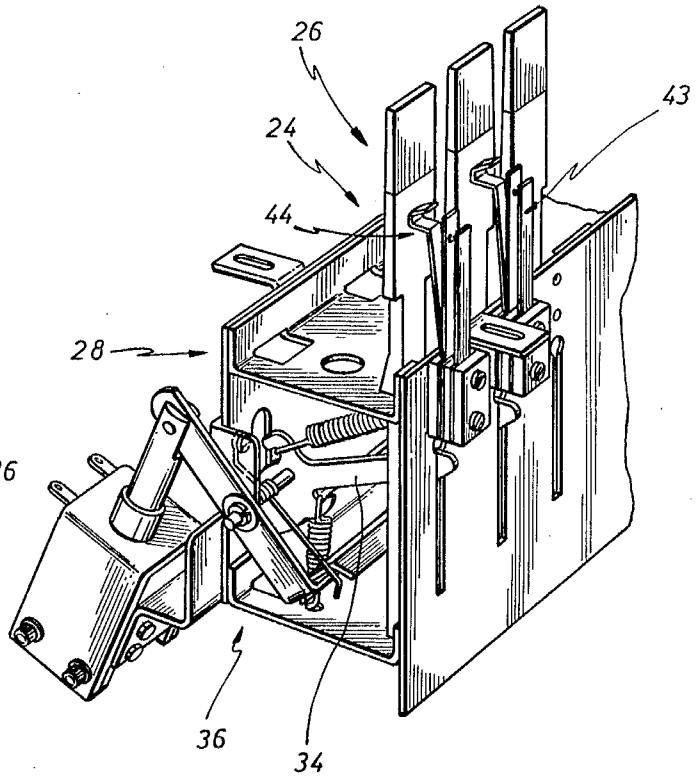
FIG. 6 is a partial backside perspective view of the drop target assembly of FIG. 5.
Figure 1:
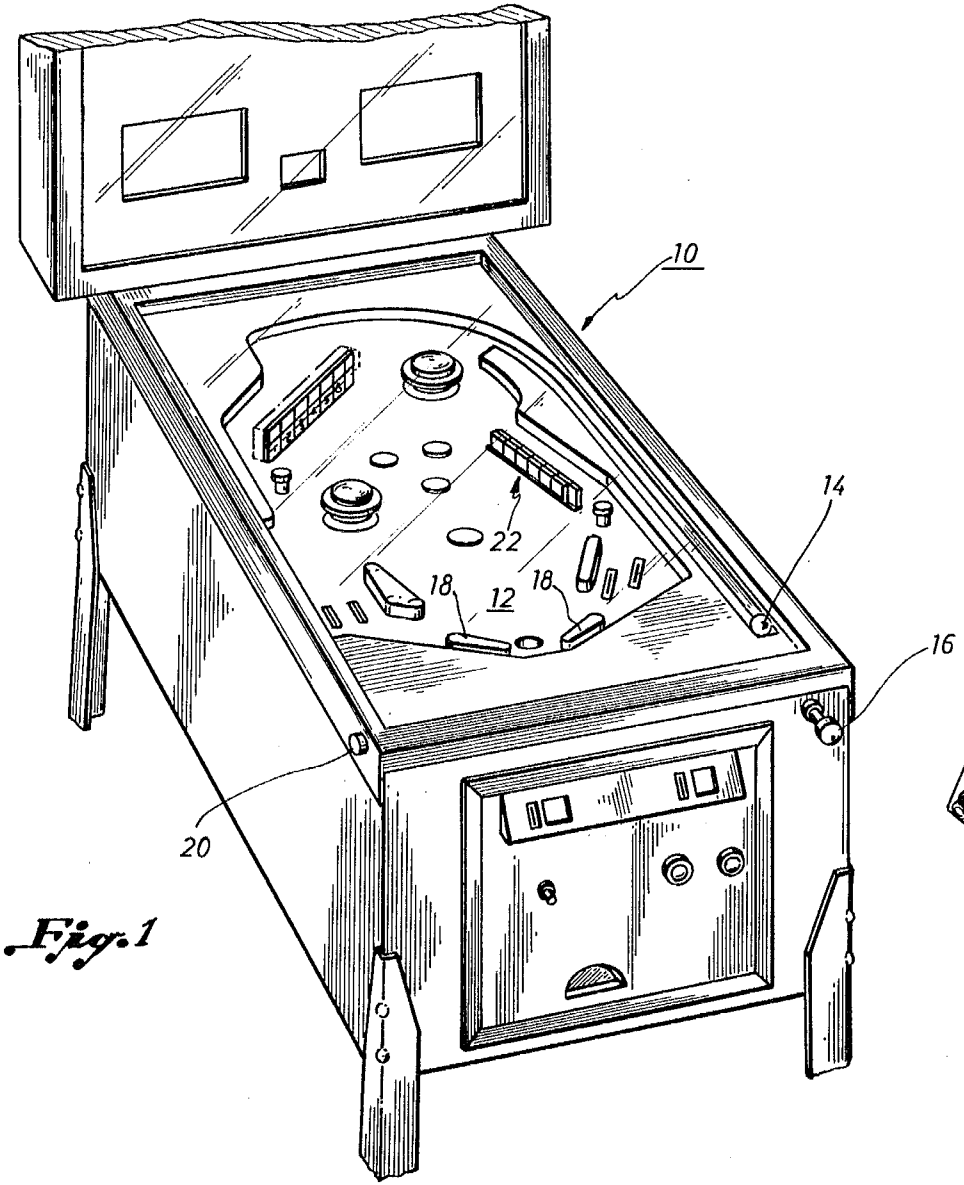
FIG. 1 is a perspective view of a playfield schematically illustrating improved drop target assemblies according to the present invention.

Referring now to the drawings, a typical pinball game machine 10 is disclosed in FIG. 1 having an inclined playfield 12 in which a ball 14 is shot into play by means of a spring plunger 16. The ball is kept in play by means of a set of flippers 18 operated in response to actuation of a pair of button switches 20 positioned along the sides of the machine 10. A suitable controller (not shown) operates the typical pop bumpers, displays, etc., according to known techniques.

In accordance with one aspect of the present invention, the playfield 12 includes a new and improved drop target assembly, indicated schematically at 22 in FIG. 1. Specifics of two embodiments of the drop target assembly 22 are shown in detail in the subsequent figures. Both embodiments are constructed to achieve the outstanding feature of providing multiple target areas for a given drop target position at a given angular orientation with respect to the flippers 18.

Referring to FIGS. 2A, 2B, 3 and 4, a first embodiment of the present invention is shown wherein the drop target assembly 22 provides multiple target areas 24, 26 arranged such that the first target area 24 is immediately in front of the second target area 26; i.e., the area 24 is disposed on the sloped playfield surface at a position closer to the flippers 18 than the area 26. In this configuration the first scoring area 24 shields the second scoring area 26 from ball engagement when the first scoring area is in a position above the surface of the playfield 12.

In more detail, a frame assembly 28 is secured to the bottom surface of the playfield 12. A plurality of sliding target members 30 are movably supported within the frame assembly 28 for vertical travel, i.e., travel in a direction transverse to the plane of the playfield. Each of the sliding target members 30 has its first target area 24 at an end, and each target area 24 extends through an opening 32 in the playfield 12. A moving mechanism 34 is provided for vertically advancing the sliding target members 30 upwardly and downwardly through the opening 32 in accordance with usual drop target operation. The moving mechanism also includes a reset mechanism 36 for advancing the sliding target members 30 upwardly through the opening 32 until the respective target areas 24 extend above the playfield 12 in a ball engageable position.

The moving mechanism 34 also includes means for holding each of the sliding target members 30 in this above-playfield surface position until the ball 14 engages the respective target area 24. Upon such ball engagement, the moving mechanism 34 drops the corresponding one of the sliding target members 30 until the target area 24 is below the surface of the playfield. A first set of switch contacts 38 may be provided to each of the sliding target members 30 to detect downward travel thereof; i.e., to detect ball actuation of the corresponding target area 24 for dropping the target.

The electrical contacts 38 are positioned on the assembly 28 with respect to the moving mechanism 34 so that as the moving mechanism 34 drops the sliding target member 30 it engages the electrical contacts 38 and closes them.

As described, the structure and operation of the moving mechanism 34, the reset mechanism 36, and the contacts 38 are conventional. This structure is shown and described in the Krynski patent which is specifically incorporated herein by reference.

According to an outstanding feature of the invention, a second set of target members 40 is provided. Each of the target members has an end which defines one of the target areas 26. A given target member 40 corresponds to an associated sliding target member 30, and it is disposed immediately behind the corresponding member 30. That is, the target member 40 is disposed so that the target area 26 is shielded from ball engagement by the target area 24 when the target area 24 is in the above-surface position.

In the preferred and illustrated embodiment, each of the target members 40 is supported with respect to the frame assembly 28 for movement in only the general direction parallel to the plane of the playfield. Thus in this embodiment the members 40 do not define drop targets.

It is suitably within, and contemplated by, the invention to include a plurality of such sliding target members 30 one in front of the other, all of which are in front of the non-dropping target member 40. In this configuration, ball engagement of the first of the sliding target members 30 would then expose the next in line sliding target member 30 etc. until reaching the non-dropping target member 40.

Figure 2B:
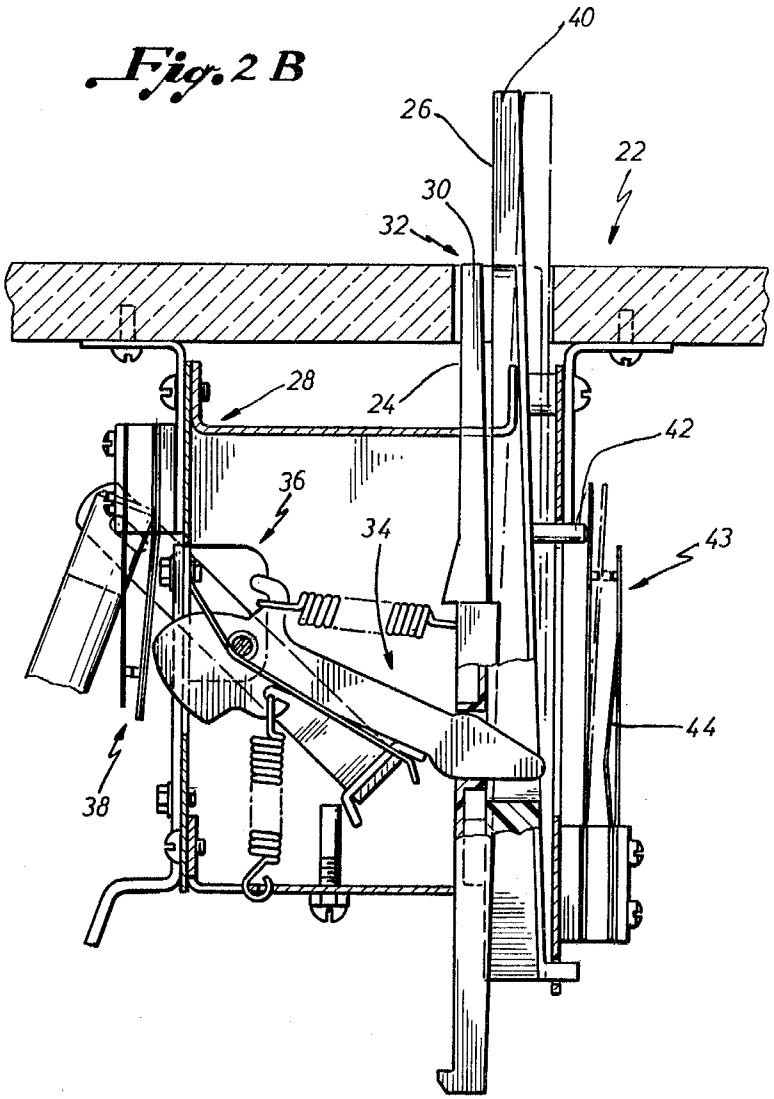
FIGS. 2A and 2B are side sectional views of one drop target assembly associated with the playfield of FIG. 1.
Figure 2A:
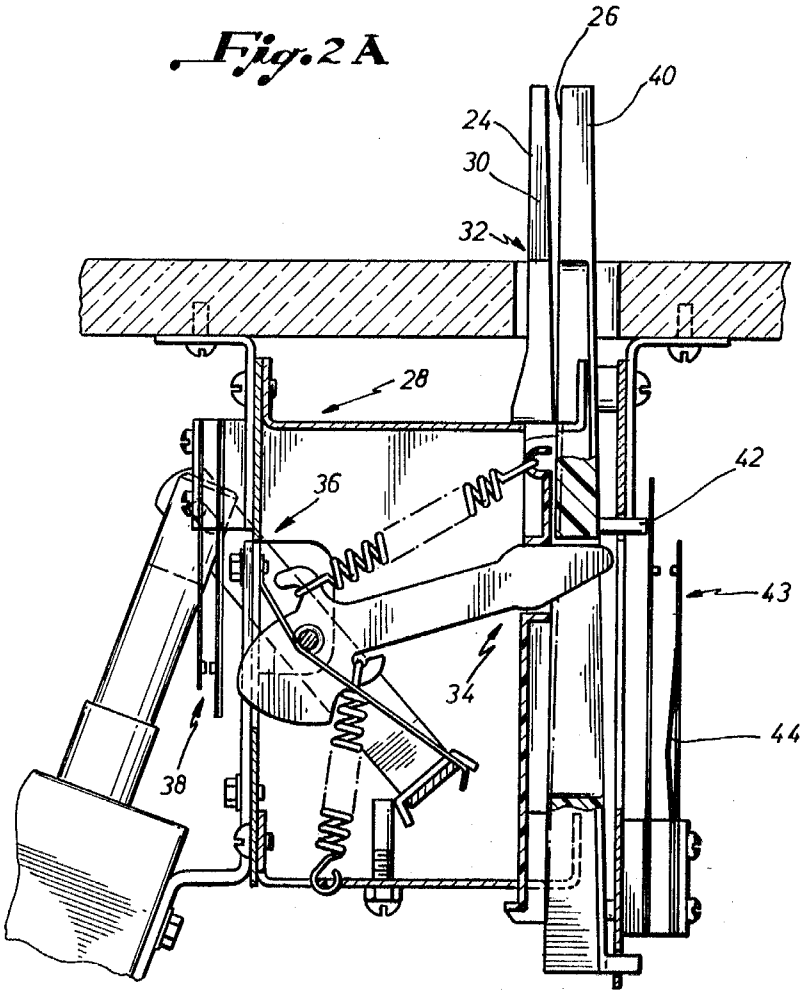
Figure 3:
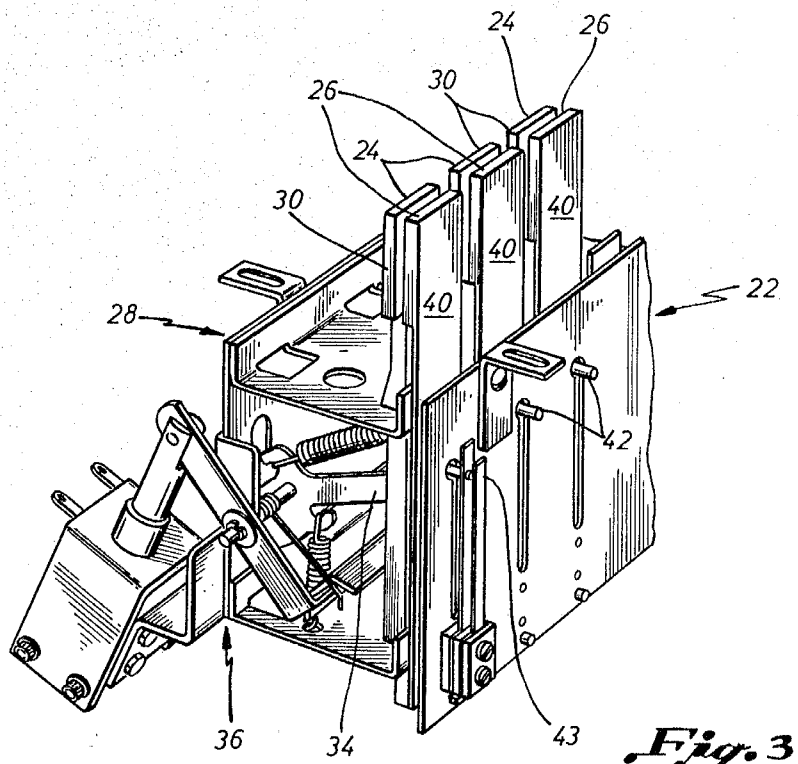
FIG. 3 is a partial backside perspective view of the drop target assembly of FIGS. 2A and 2B in association with the playfield.
Figure 4:
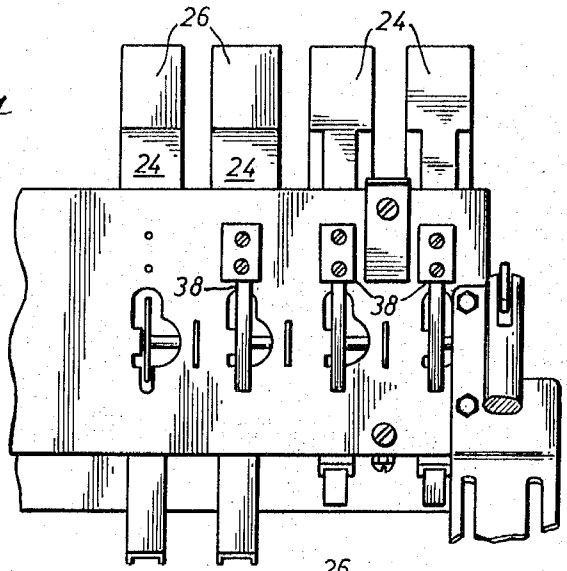
FIG. 4 is a partial front view of the drop target assembly of FIG. 3.

Referring to FIGS. 2A, 2B, and 3, each of the target members 40 has a laterally extending projection 42. The projection 42 extends through apertures in the frame assembly 28 a distance to engage a second set of electrical contacts 43 which are disposed behind the target members 40. The distance between the projection 42 and the contacts 43 is selected to maintain the set of contacts 43 in one state, such as open, in the quiescent or non-ball actuated condition of the target areas 24, 26 but which changes the state of the contacts, i.e., closes them, upon ball engagement of the target areas 24, 26. In the illustrated embodiment, the set of contacts 43 is on a supporting element 44 of sufficient resiliency to urge the target member 40 forward to the quiescent state, yet allow rearward travel of the member 40 to close the contacts 43 upon ball engagement of the target areas 24, 26.

Accordingly, initial ball engagement of the sliding target member 30 causes actuation of the electrical contacts 38. Further ball engagement with the member 30 actuates the contacts 43. Accordingly, actuation of the electrical contacts 38 corresponds to actuation of the target area 24 and all actuations of the electrical contacts 43 correspond to actuation of the target area 26.

It is understood that the set of electrical contacts 38 is not a necessary part of the invention. The single set of contacts 43 could be utilized such that the first actuation thereof corresponded to ball engagement of the target area 24 and all subsequent actuations corresponded to actuation of the target area 26. Since modern day pinball games commonly employ computer control systems, it is a relatively simple matter for the computer to be programmed to detect switch contact closures and to keep track of the number and sequence of actuations of the electrical contacts 43.

Refering now to FIGS. 5–7A, 7B, a second embodiment is shown wherein the target areas 24, 26 for a given drop target location are on a single target member 30, thereby eliminating the described second set of target members 40. To accommodate the additional target area 26 the respective sliding targets 30 are of increased length so that an additional length of the respective targets 30 extends above the surface of the playfield 12.

Although shown in the preferred and illustrated embodiment as only first and second target areas 24, 26, it is understood that an additional number of target areas may be added to the sliding target 30 according to the invention. In this case, ball actuation of a given target area would drop the member 30 only to a position allowing ball engagement of the next target area, and so forth.

The embodiment of FIGS. 5–7B also has the conventional moving mechanism 34, reset mechanism 36 and contacts 38 as described in the earlier embodiment.

In operation, upon ball engagement of the target area 24, the sliding target member 30 is impacted rearwardly, releasing the sliding target member 30 to be pulled downwardly by the moving mechanism 34. This drops the target area 24 from the above-playfield surface position to a below-playfield surface position and drops the target area 26 to the above-playfield position which is ball actuable. When the target area 24 is in a ball actuable above-playfield surface position, the target area 26 is generally in a non-ball actuable position.

Figure 5:
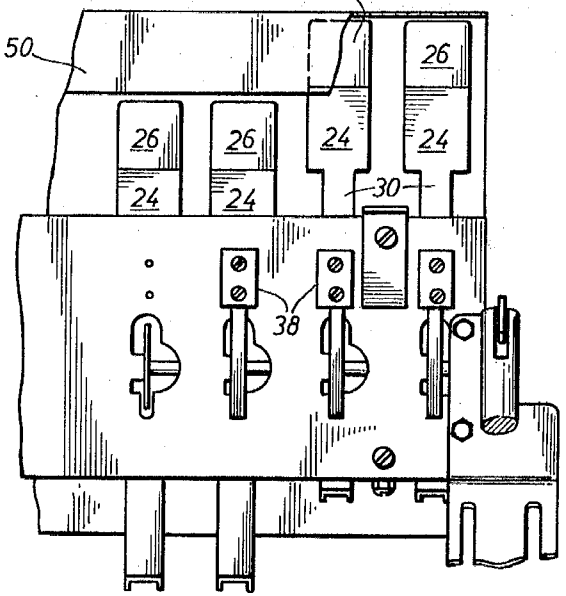
FIG. 5 is a partial front side cutaway view of another drop target assembly in association with the playfield of FIG. 1.
Figure 7B:
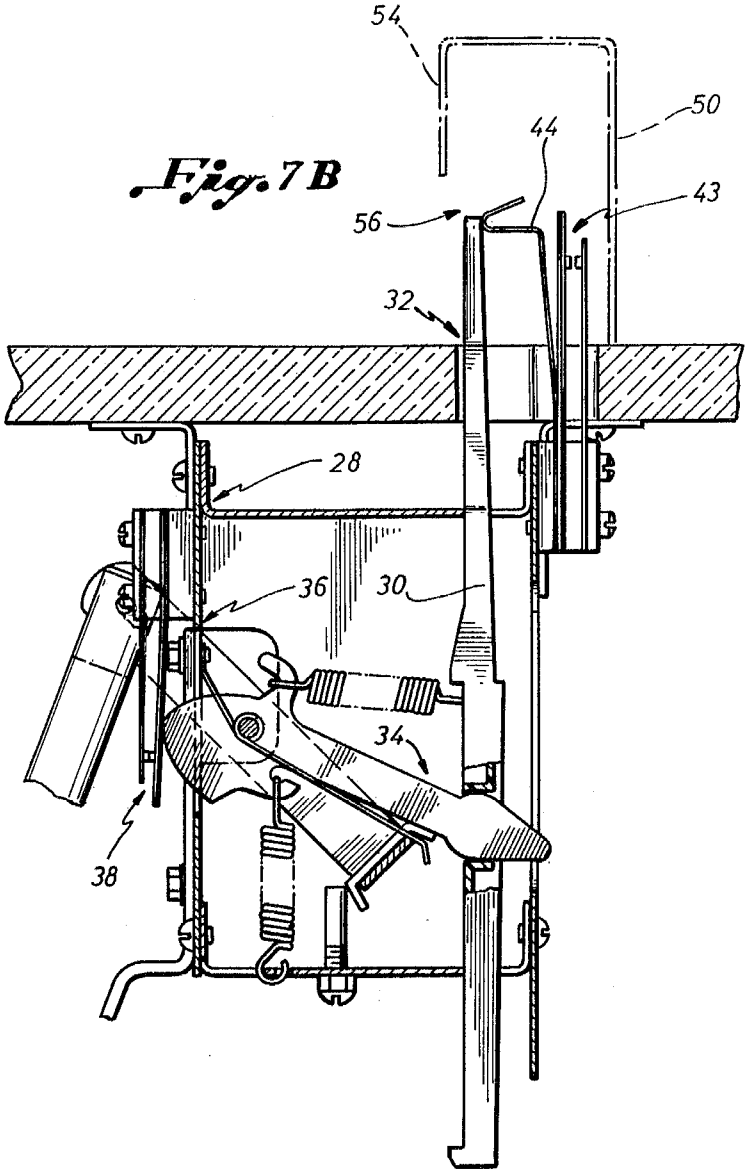
FIGS. 7A and 7B are side sectional views of the drop target assembly of FIG. 6.
Figure 7A:
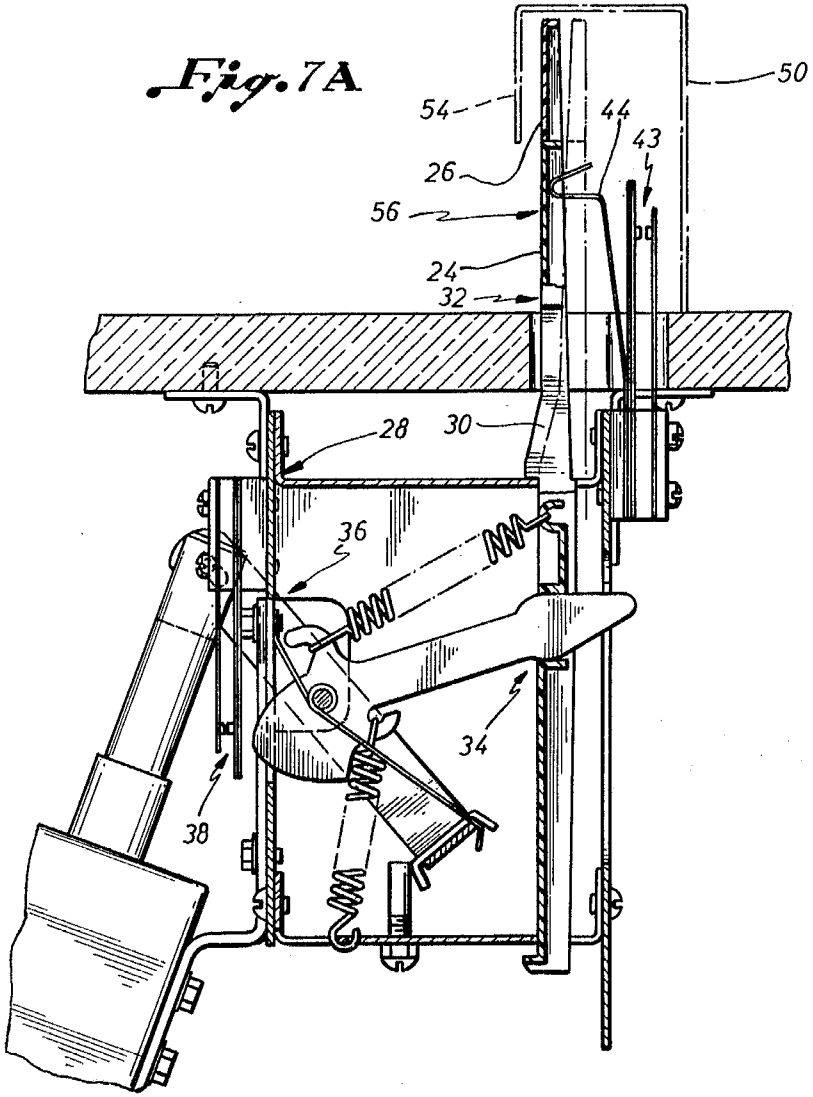

Referring to FIGS. 5, 7A–7B, a housing 50 may be provided on the playfield 12 to cover or otherwise conceal the target area 26 when the target area 24 is in the above-playfield position. The housing 50 has a front surface 54 which extends from a position elevated above the playfield surface downwardly a limited distance to cover only the target area 26. This defines an opening 56 to allow ball access to the target area adjacent the playfield surface. Accordingly, the surface 54 blocks the target area 26 from the view of the player until the player has dropped the target 24 via ball engagement therewith. Upon this condition the target area 26 automatically and rapidly appears in the opening 56. Although the housing 50 is not a necessary part of the invention, it is believed to increase player appeal by keeping the target area 26 hidden from view until it becomes accessible for play. Since the target area 26 is of a color and visual appearance different from the target area 24, this rapid change promotes player appeal.

It will therefore be appreciated that a new and improved drop target assembly has been disclosed. The drop target assembly provides multiple target areas for increasing player appeal and promoting attractiveness of game play.

Although the invention has been described in its preferred form with a certain degree of particularity, it is understood that the present disclosure has been made only by way of example. Numerous changes in the details and construction of the combination and arrangement of parts will be apparent without departing from the spirit and the scope of the invention.

What is claimed is:

1. In a flipper-type pinball game machine of the type having an inclined playfield which supports a rolling ball and one or more drop target assemblies, each drop target assembly having a target member which extends through an opening in the playfield to define a ball engageable target area and which is movable to advance the target area between a position above the surface of the playfield and a position below the surface of the playfield, the improved drop target assembly comprising:

(a) means, including at least one slidable member, defining at least first and second ball engageable target areas above the playfield surface, wherein the slidable member is an elongated member having a portion extending above the playfield surface and which defines the first and second target areas to be at different elevations above the playfield when the first target area is in an above-surface position, the slidable member being movable to advance the first target area between a position above the surface of the playfield and a position below the surface of the playfield without advancing the second target area below the playfield surface;

(b) a mechanism for moving the one slidable member upon ball engagement of the first target area, thereby advancing the first target area to the below-surface position and providing said second target area for ball engagement; and (c) a set of switch contacts disposed in association with the elongated member on the side thereof opposite ball engagement and at an elevation to enable ball engagement of either the first or second target areas to actuate the switch contacts.

2. The improved drop target assembly according to claim 1, wherein the target area defining means includes a housing disposed on the playfield surface for shielding the second target area when the first target area is in the above-surface position.

3. The improved drop target assembly according to claim 1 and including a second set of switches disposed to be actuated by said moving mechanism for indicating when said first target area has advanced to the below-surface position.

4. The improved drop target assembly according to claim 1 and including means for resetting the target area defining means for repositioning the first target area to the above-surface position.

5. In a flipper-type pinball game machine of the type having an inclined playfield which supports a rolling ball and one or more drop target assemblies, each drop target assembly having a ball engageable target member which extends through an opening in the playfield to define a target area and which is movable to advance the target area between a position above the surface of the playfield and a position below the surface of the playfield, the improved drop target assembly comprising:

(a) a frame for mounting to the bottom surface of the playfield;

(b) first and second target areas respectively supported with respect to the frame at positions above the playfield surface which allow only alternate engagements of the target areas by the ball, whereby the second target area is engageable by the ball substantially only when the first target area is not engageable by the ball;

(c) a moving mechanism supported by the frame for advancing the first target area to a position below the surface of the playfield without advancing the second target area below the playfield surface, thereby providing said second target area for ball engagement, wherein said moving mechanism comprises an elongated member which defines the second and first target areas respectively at a location substantially at the end of the elongated member and at a location spaced from the end and adjacent the end location; and (d) a set of switch contacts disposed in association with the elongated member on the side thereof opposite ball engagement and at an elevation to enable ball engagement of either the first or second target areas to actuate the switch contacts.

* * * * *